US008646606B2

(12) United States Patent
Glass et al.

(10) Patent No.: US 8,646,606 B2
(45) Date of Patent: Feb. 11, 2014

(54) GIFT CARD PACKET HOLDER

(75) Inventors: Brett R. Glass, Overland Park, KS (US); Nicole E. Glass, Overland Park, KS (US)

(73) Assignee: Gift Card Impressions, LLC, Kansas City, MO (US)

( * ) Notice: Subject to any disclaimer, the term of this patent is extended or adjusted under 35 U.S.C. 154(b) by 0 days.

(21) Appl. No.: 13/031,042

(22) Filed: Feb. 18, 2011

(65) Prior Publication Data

US 2012/0048766 A1 Mar. 1, 2012

Related U.S. Application Data

(60) Provisional application No. 61/305,943, filed on Feb. 18, 2010.

(51) Int. Cl.
*A45C 11/18* (2006.01)

(52) U.S. Cl.
USPC ..... 206/449; 206/39

(58) Field of Classification Search
USPC ..... 206/37, 39, 39.1, 39.7, 476, 312, 449, 206/555; 229/72, 92, 92.8
See application file for complete search history.

(56) References Cited

U.S. PATENT DOCUMENTS 3,655,119 A * 4/1972 Thompson ..... 229/72
3,858,791 A * 1/1975 Gendron ..... 229/72
4,739,877 A * 4/1988 Olson ..... 206/38.1
5,662,217 A * 9/1997 Durr ..... 206/308.1
5,690,219 A * 11/1997 Harrer ..... 206/308.1
5,791,474 A 8/1998 Hansen
5,884,770 A 3/1999 Galm
5,943,800 A 8/1999 Rose
6,224,108 B1 5/2001 Klure
6,349,829 B1 * 2/2002 Matheis et al. ..... 206/449
6,877,263 B2 4/2005 Clark
6,966,135 B1 11/2005 McDonald
7,024,807 B2 4/2006 Street
7,275,683 B2 10/2007 Lazarowicz et al.
7,490,720 B2 2/2009 Cole et al.
7,520,425 B2 4/2009 Clegg
8,061,515 B2 * 11/2011 Carrasquillo ..... 206/312
2003/0192209 A1 10/2003 Yeh
2005/0035006 A1 * 2/2005 Dohner ..... 206/39
2006/0000127 A1 1/2006 Schindele
2006/0101678 A1 5/2006 Wilen
2006/0151348 A1 7/2006 Willard
2006/0255154 A1 11/2006 Newbrough et al.
2007/0094901 A1 5/2007 Kibbe et al.
2007/0200000 A1 8/2007 Sanders
2007/0251994 A1 11/2007 Kingsborough et al.
2008/0116088 A1 5/2008 Roberts
2008/0116089 A1 5/2008 Roberts
2009/0038968 A1 2/2009 Smith
2009/0091123 A1 4/2009 Conley et al.

* cited by examiner

*Primary Examiner* — Jacob K Ackun
(74) *Attorney, Agent, or Firm* — Polsinelli PC

(57) ABSTRACT

A device for holding a gift card packet while providing graphical, mechanical and audio enhancements, alone or in combination, to entertain the gift card packet recipient and add value the gift.

3 Claims, 4 Drawing Sheets

GIFT CARD PACKET HOLDER

CROSS REFERENCE TO RELATED APPLICATIONS

This application claims the benefit of the prior filed, co-pending provisional application Ser. No. 61/305,943, filed Feb. 18, 2010.

BACKGROUND OF THE INVENTION

This invention relates generally to gift card holders and more particularly to a device for holding a gift card packet while providing graphical, mechanical and audio enhancements, alone or in combination, to entertain the gift card packet recipient and add value the gift.

Transaction cards, stored value cards, or gift cards, as they are commonly called based upon their intended use, have become popular gifts. Gift cards typically comprise a stored value card whereby a certain cash equivalent value is encoded upon a magnet strip applied to the surface of the card. This stored value may be determined by the vendor prior to packaging and display for sale or, more commonly, is selected at the point of sale by the purchaser and loaded by the cashier using a magnet card reader/writer. While popular, gift cards are typically provided with a generic and impersonal design, typically identifying the associated merchant for which the card may be used to purchase merchandise, and therefore are not personalized in view of the intended recipient.

A further development in the marketing of gift cards includes enclosing a gift card within a sealed gift card packet. The gift card packet, known in the prior art, typically comprises two similarly sized sheets of card stock or heavy paper adhered to one another, one sheet on top of the other, to enclose a gift card therein. One of the sheets typically includes a magnet strip that may be read by a conventional magnetic card strip reader. Electrical or electromagnetic means connect the packet magnetic strip to the magnetic strip of the gift card itself, so that when information is received or transmitted via a reader to the packet strip, such information is conveyed to or from the gift card strip. Some gift card packets can be activated by scanning a UPC bar code located on the back of the packet, rather than swiping a magnetic strip.

Gift card packets are often presented for sale on display racks in stores, each packet being hung upon a display stand peg. A given area of a store will only support a certain number and size of display stands, given store traffic and other considerations, which makes allocation of display space an important marketing decision that may require selecting only certain high selling cards for display. Display of other items in the same store area will typically reduce the substantially finite space available for displaying gift cards and gift card packets.

In addition to the above considerations, gift card packets must fit within a set, allocated space in pre-existing displays. A gift card packet must not exceed 5.25" tall and 4" wide. These dimensions are an industry standard and are typically non-negotiable. In order to properly hang each gift card packet, the packet typically includes a J-hook hole (sombrero cut) with the exact dimensions of 1.875" wide by 0.5" high and be placed 0.1875" from the top of the packet. Presently, the above requirements pertain to approximately 95% of all gift cards and gift card packets that are sold at retail.

Devices for recording, storing and playing back audio have been associated with greeting cards and the like, such as is disclosed in U.S. Pat. Nos. 5,577,018; 5,652,606 and 6,845, 583. The audio circuitry typically includes a speaker that also functions as a microphone when recording a message, a control circuit, a memory circuit to provide random access memory, one or more switches, batteries to provide power to the device, and associated wiring and mounting hardware.

What is needed, therefore, is a device capable of readily holding a gift card packet and providing one or means to personalize the gift and also graphical, mechanical and audio enhancements, alone or in combination, to entertain the gift card packet recipient and enhance the value of the gift card to the recipient.

BRIEF DESCRIPTION OF THE INVENTION

The purpose of this invention is to provide a holder for receiving and holding a gift card packet. The holder includes a slot leading to a pocket in a holder panel, all specially sized for receiving a gift card packet, and may include one or more enhancement elements such as graphics and text upon the holder surfaces, pop-up elements that move and stand off from the surfaces of the holder when the holder is opened, and a sound circuit that is activated upon opening the holder.

A gift card packet holder may include a first panel in planar alignment with and adhered to a second panel to form a pocket for housing a gift card packet, said first panel having a width slightly exceeding that of said second panel whereby two opposing edges of said first panel extend past the proximate edges of said second panel prior to attachment of said first panel to said second panel and whereby a central portion of said first panel is deflected upward when said first panel edges are attached to said second panel edges, the deflected first penal thereby forming an open space between said first panel and said second panel for accommodating a gift card packet inserted therein through a slot formed in said either of said panels.

Other advantages of the invention will become apparent from the following description taken in connection with the accompanying drawings, wherein is set forth by way of illustration and example an embodiment of the present invention.

DETAILED DESCRIPTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
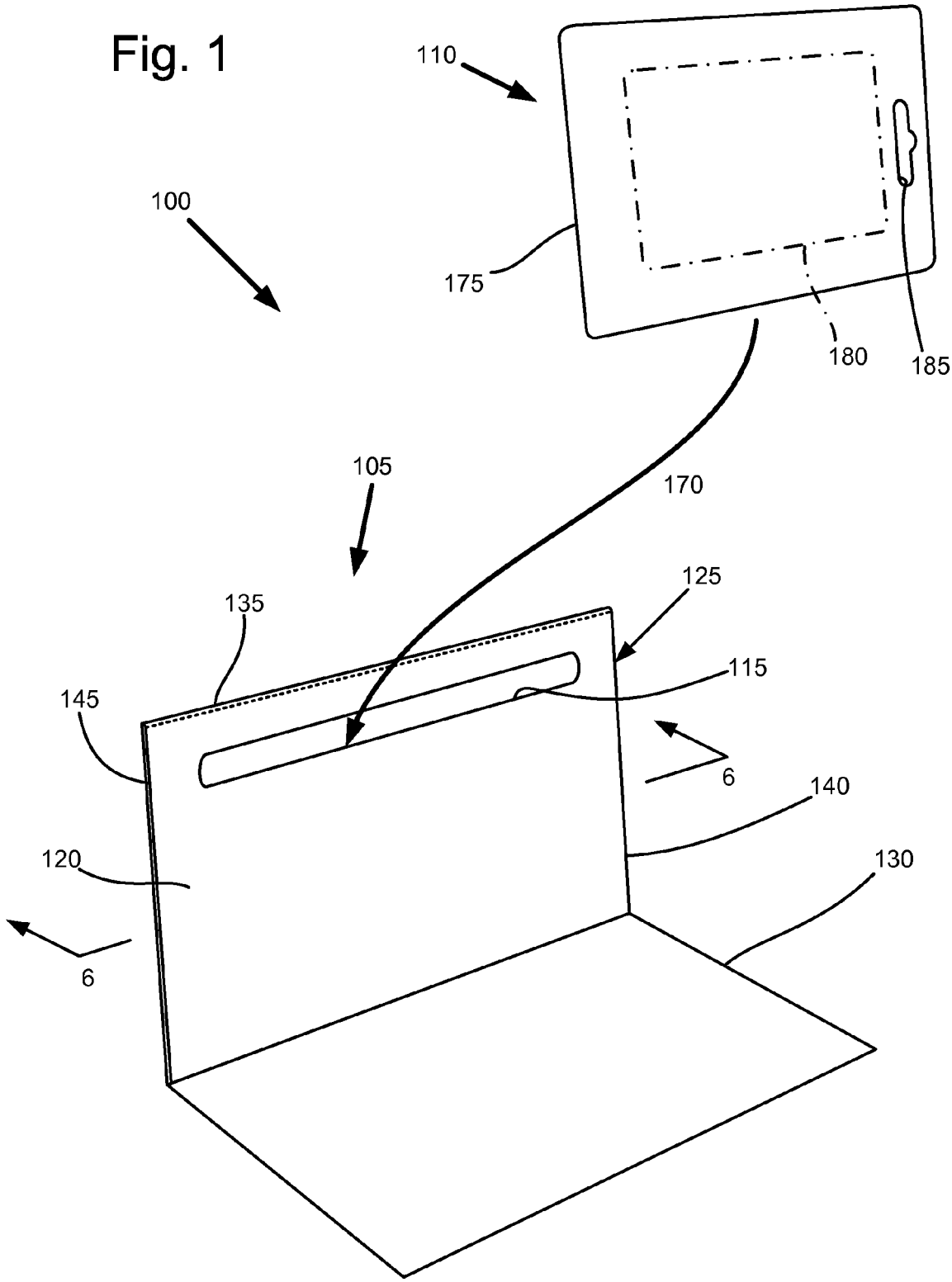
FIG. 1 is an illustration showing a gift card packet holder and a gift card packet positioned prior to insertion of the packet into the holder slot and pocket.

With reference to the figures, FIG. 1 is an illustration of a transactional and/or stored value gift 100 comprising a gift card packet holder 105 and gift card packet 110. The holder 105 includes a slot 115 that leads to a pocket 120 within in the cover 125. The slot 115 is dimensioned to receive the packet 110, which is inserted into the pocket 120 prior to giving the gift 100 to a recipient. The holder 105 typically includes two hingedly connected major panels, the cover panel 125 and back panel 130. It should be appreciated that the terms "cover" and "back" are used for convenience and that, depending upon the desired orientation of the holder 105, either major panel may serve as the cover (i.e. frontmost or topmost panel depending on desired orientation of use).

The cover panel 125 typically comprises two thicknesses of cardstock or similar material (subpanels 140 and 145) that are adhered or otherwise attached together around the margins to form an enclosure or pocket 120. The slot 115 is typically formed in the innermost 140 of the cover subpanels so that the slot 115 is protected when the holder 105 is closed. The back panel 130 may comprise one or more thicknesses of cardstock or similar material. For convenience, the holder panels 125 and 130 may be formed from one piece of material that is cut and folded along hinge line 135 to form the holder structure.

Figure 2:
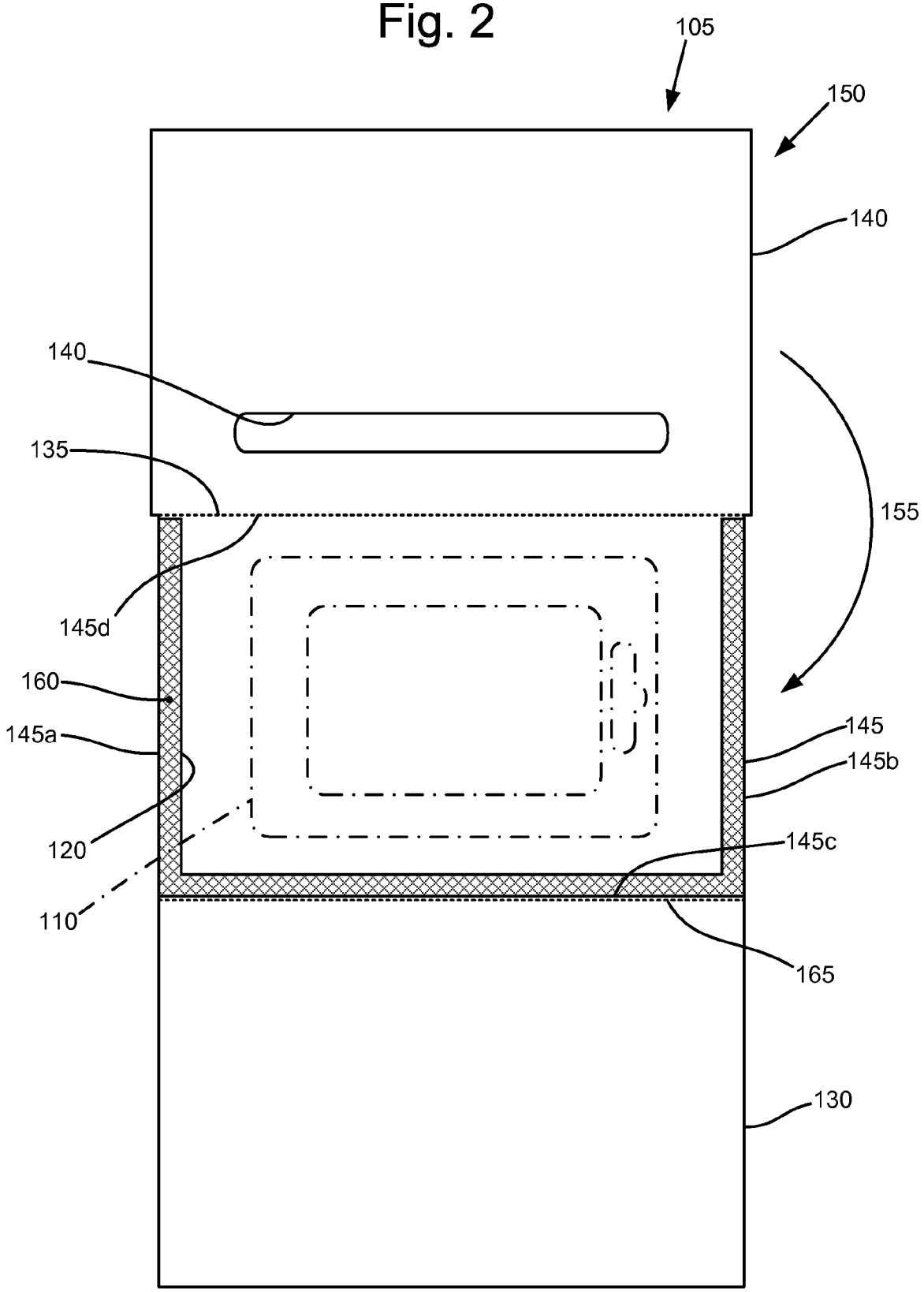
FIG. 2. Is a plan diagram showing a three panel card stock base from which the holder is formed.

FIG. 2. Is a plan diagram showing a three panel card stock base 150 from which a holder 105 may be formed. As illustrated, the first (top) panel 140 includes a slot 115 therein. As indicated by arrow 155, the first panel 140 is folded downward upon the second (middle) panel 145 to engage adhesive 160 (indicated by shading) placed around the left 145*a*, right 145*b* and bottom 145*c* margins of the second panel 145, thereby forming, when assembled, an enclosed pocket with egress limited to the slot 115. Adhesive is not required at the top margin 145*d* of the second panel 145 because the second panel 145 and first panel 140 are connected along fold line 135, which defines the top margin 145*d* of the second panel 145 and the bottom margin of the first panel 140. Fold line 165 defines the bottom margin 145*c* of the second panel 145 and the top margin of the third panel 130. When assembled the holder 105 attains the structure shown in FIG. 1. Although not so-positioned while the holder 105 is being assembled, a packet 110 is shown in phantom lines within the space defined by the pocket 120 post-holder assembly to indicate approximately where a packet 110 will lie within the holder 105 after insertion through the slot 115.

Returning to FIG. 1, the gift card packet 110 is shown positioned upward of the holder 105 prior to insertion of the packet 110 into the holder slot 115 and pocket 120, as indicated by arrow. The packet 110 typically comprises a generally rectangular casing 175 of card stock or similar material enclosing a gift card therein. A gift card 180 within the packet 110 is indicated in phantom lines. A gift card packet 110 typically will include a sombrero-cut hole for hanging the packet upon a display peg (not shown).

Figure 3:
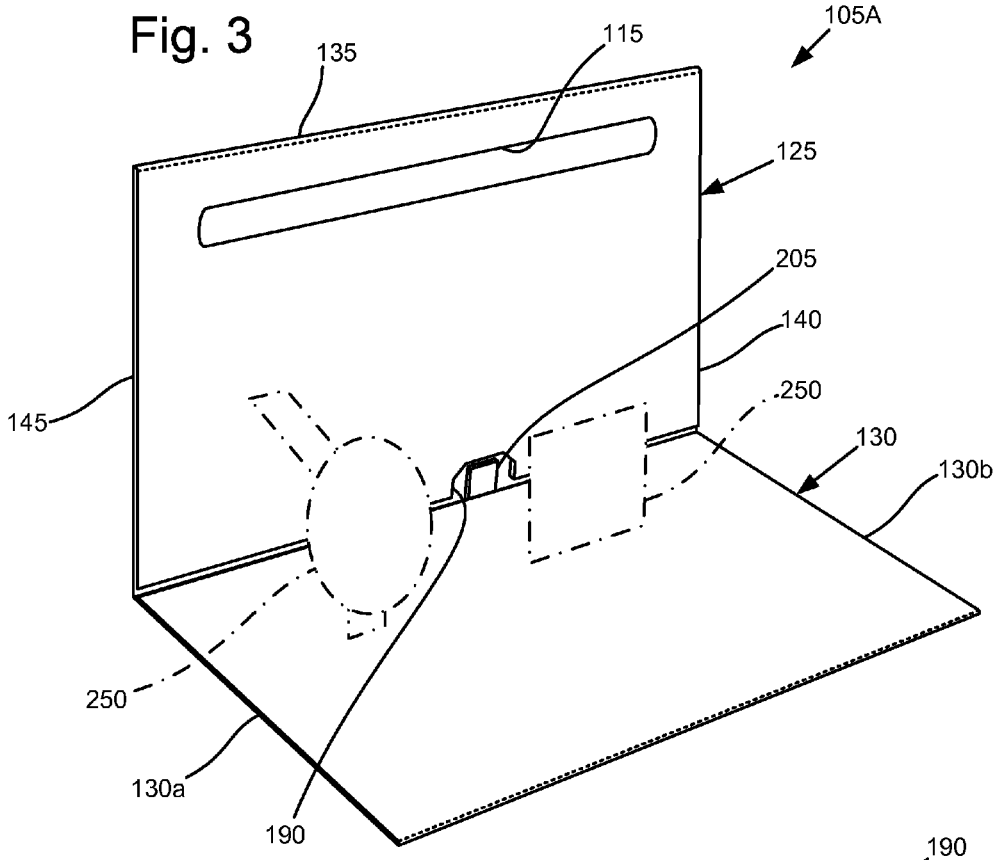
FIG. 3 is an illustration of an alternative embodiment of a gift card packet holder including pop-up elements and a sound producing element.

FIG. 3 is an illustration of an alternative embodiment of a gift card packet holder 105A. The holder 105A includes a fourth base panel 130*b* that is folded up and over the third panel 130*a* to form a back panel 130 with an enclosure to house sound producing components, namely a sound producing electrical circuit 200 (see FIG. 4). As shown, a sliding tongue 205 projects from between the third 130*a* and fourth 130*b* panels to pass through a notch 190 in the first panel 140 and to attach to the inner surface of the second panel 145. When the holder 105A is opened by lifting the cover 125 (formed from the first 140 and second 145 panels), the tongue 205 is thereby pulled by movement of the second panel 145 away from the back panel 130. As the tongue 205 is pulled it engages the circuit 200 to activate a circuit switching mechanism 210 that further activates the circuit 200 to produce a sound from a recording on a circuit memory chip 215. When the cover 125 is closed against the back panel 130, the tongue 205 slides the opposite direction to deactivate the sound circuit 200. The sound circuit 200 typically includes a speaker 220, that may also function as a microphone in some embodiments, a recording switch 225, if the circuit 200 includes a record function, one or more batteries 230*a* and 230*b* for providing electrical power to the circuit, a circuit board 235 or other platform to support the circuit components, and various wires 240 to connect the circuit components. Methods of constructing and operating sound circuits of this type are well known in the prior art.

FIG. 3 also illustrates pop-up elements 250 attached to, and in one instance bridging, the first 140 and fourth 130*b* panels. Pop-up elements 250 may take any desired and operable shapes and dimensions. The pop-up elements 250 are constructed to fold upon the closure of the holder 105A and to project away from the plane of either the first 140 or fourth panel 130*b*, or both, upon opening the holder 105A.

Figure 4:
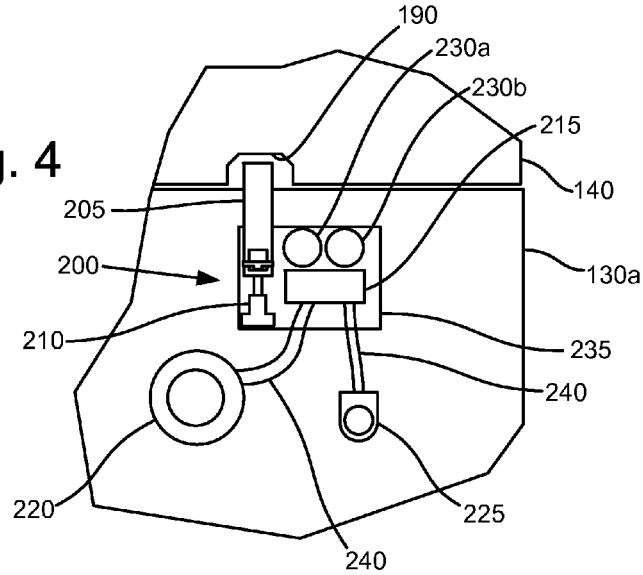
FIG. 4 is a cut-away view of a holder showing the cover and the fourth panel upon which a sound circuit is mounted.

FIG. 4 is a cut-away view of a holder 105A showing the cover 125 and the third panel 130*a* upon which a sound circuit 200 is mounted.

Figure 5:
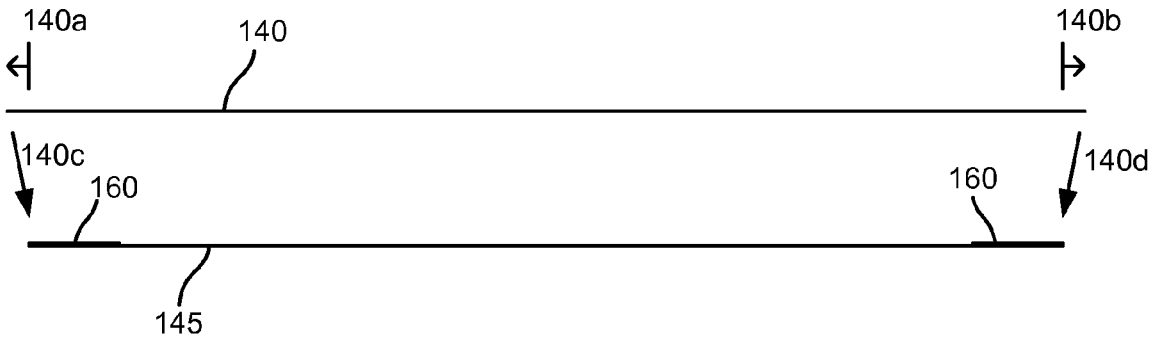
FIG. 5 is a cross section showing the first panel positioned above the second panel prior to attachment of the two panels to each other via adhesive shown on the left and right upper margins of the second panel.
Figure 6:
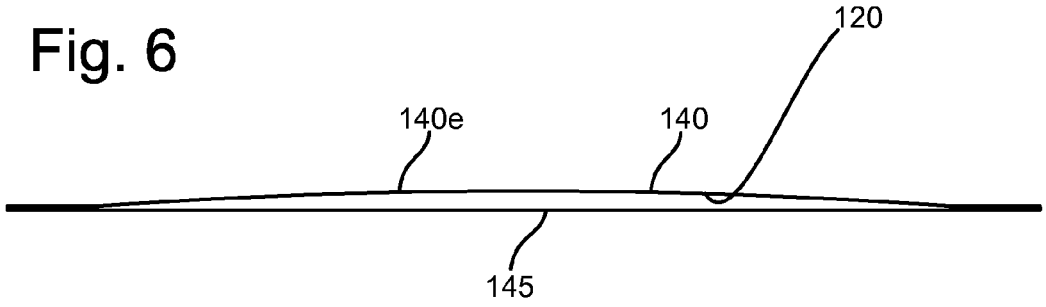
FIG. 6 is a cross section taken through line 6-6 in FIG. 1 showing the first panel attached to the second panel to form a pocket.
Figure 7:
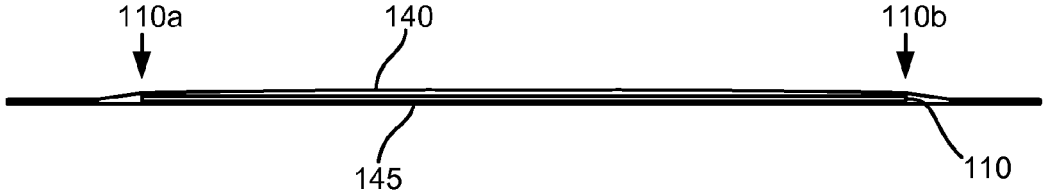
FIG. 7 is a cross section showing the gift card packet inserted between the first and second panels.

FIGS. 5 through 7 illustrate a progression in which the first panel 140 is adhered to the second panel 145 to form a pocket 120 for housing a gift card packet 110. FIGS. 5 through 7 are cross sectional illustrations of the panels 140 and 145 and other illustrated elements (adhesive 160 and packet 110), as indicated by arrows 6-6 in FIG. 1 from which the cross sectional drawing of FIG. 6 is taken. In FIG. 5, the first panel 140 is shown positioned above the second panel 145 prior to attachment. The first panel 140 is typically slightly wider than the second panel 145. In some embodiments the first panel 140 extends approximately 1/16 inch beyond the second panel 145 on either side. See arrows 140*a* and 140*b*. (Note that drawings are not to scale or to relative scale.) As the first panel 140 is brought into contact with the second panel 145, the left and right edges of the first panel 140 are bent slightly inward (as indicated by arrows 140*c* and 140*d*) to align with and contact adhesive 160 applied to the upper left and right margins of the second panel 145. In this manner, the center portion 140*e* of the first panel is caused to deflect upward, thereby forming an open space within the pocket 120. This additional space allows for sufficient room to accommodate the gift card packet 110 when it is inserted into the pocket 120 via the slot 115 (not shown in FIGS. 5-7). As illustrated in FIG. 7, the gift card packet 110 will typically deflect the top panel 140 slightly upward at the left and right margins of the packet (see arrows 110*a* and 110*b*) as the packet 110 is slid between the first 140 and second 145 panel. The panels 140 and 145 provide lessened resistance to the packet 110 being inserted therebetween due to the extra space proved by the top panel 140. As the portions of the top panel 140 overlying the left 110*a* and right 110*b* margins of the packet 110 are deflected slightly upward, the center portion 140*e* of the top panel is typically drawn slightly downward, whereby the pocket 120 may provide a snug fit for the packet 110 without presenting excess resistance to insertion or removal of the packet 110 therefrom.

Having thus described the invention, what is claimed as new and desired to be secured by Letters Patent is:

1. A gift card packet holder comprising:

a back panel hingedly connected to a cover panel, said cover panel comprising:

a first subpanel comprising a first subpanel interior surface;

a second subpanel comprising a second subpanel interior surface; wherein the first subpanel interior surface is contiguous with the second subpanel interior surface; and wherein the first subpanel interior surface is engaged to the second subpanel interior surface about a periphery of the second subpanel interior surface to form a pocket;

wherein said first subpanel includes a slot therein dimensioned to receive a gift card packet therethrough and into said pocket; and said first subpanel having a width greater than said second subpanel, such that a center portion of said first panel deflects away from the second subpanel to form an open space within said pocket to decrease resistance to insertion of said gift card packet between said first subpanel and said second subpanel.

2. The gift card packet holder of claim 1, wherein the first subpanel interior surface is engaged to the second subpanel interior surface by an adhesive placed around at least one margin of the second subpanel interior surface.

3. The gift card packet holder of claim 1, wherein the first subpanel interior surface is contiguous to the second subpanel interior surface via a fold in the cover panel.

* * * * *